United States Patent [19]

Vadnay

[11] Patent Number: 4,978,078

[45] Date of Patent: Dec. 18, 1990

[54] APPARATUS FOR DEHUSKING GRAIN

[76] Inventor: Laszlo Vadnay, 4 McPherson Street, Banksmeadow, N.S.W., Australia

[21] Appl. No.: 399,561

[22] PCT Filed: Jan. 27, 1988

[86] PCT No.: PCT/AU88/00013

§ 371 Date: Aug. 29, 1989

§ 102(e) Date: Aug. 29, 1989

[87] PCT Pub. No.: WO88/05339

PCT Pub. Date: Jul. 28, 1988

[30] Foreign Application Priority Data

Jan. 27, 1987 [AU] Australia ..... P13758

[51] Int. Cl.[5] ..... B02C 9/00; B02C 19/22

[52] U.S. Cl. ..... 241/74; 99/605; 99/622; 241/7; 241/260.1; 241/14

[58] Field of Search ..... 99/605, 618, 622, 608, 99/617, 618; 241/6-13, 260.1, 74, 14, 73

[56] References Cited

U.S. PATENT DOCUMENTS

| | | | |
|---|---|---|---|
| 1,693,847 | 12/1928 | Lee | 99/605 |
| 2,791,254 | 5/1957 | Crane | 99/622 X |

FOREIGN PATENT DOCUMENTS

| | | | |
|---|---|---|---|
| 1306637 | 9/1962 | France . | |
| 18050 | of 1915 | United Kingdom | 99/622 |
| 1052819 | 12/1966 | United Kingdom . | |
| 1461481 | 1/1977 | United Kingdom . | |
| 2162809 | 2/1986 | United Kingdom . | |

*Primary Examiner*—Mark Rosenbaum

*Attorney, Agent, or Firm*—Kinney & Lange

[57] ABSTRACT

A discoid element (7, 8) for a helical screw or worm arrangement comprising, on each side, identical shallow depressions (20); each depression having an open end (21) adjacent the periphery and a closed end (22) adjacent a central bore (23). The depressions (20) in one side of the discoid element are staggered with respect to those of the other side. The discoid element may also contain radial ribs (24, 25, 26, 27) constituting the sidewalls of the shallow depressions. The discoid elements may suitably be used in apparatus for dehusking grain.

6 Claims, 3 Drawing Sheets

APPARATUS FOR DEHUSKING GRAIN

BACKGROUND OF THE INVENTION

1. Field of the Invention

This invention relates to the production of grain flour, primarily wheat flour, and more particularly to an apparatus for the dehusking of such grain preparatory to the grinding thereof to produce the flour.

2. Description of the Prior Art

After removal of the grain from the heads of the stalks of cereal plants, it is usual, at least in modern western technology, to mill it by passing a stream of it successively through a "train" of paired rollers. These rollers, when at the upstream end of a flour mill, have figured or otherwise roughened surfaces and are journalled so as to provide a nip therebetween commensurate with grain size whereas, at the downstream end of such a mill, the rollers are journalled so as to have a much narrower nip and are provided with substantially smooth surfaces.

During its passage through such a train of pairs of prior known rollers, the grain is only partially dehusked and also, inevitably, partially crushed and/or ground at each stage. Between the stages and especially in the region of the upstream stages the grain is winnowed, or subjected to a shaking process which may be accompanied by a fanning or blowing step, either of which steps is intended to blow the bran, that is to say, comminuted grain husk, free from the heavier material which is composed partly of grain kernel and partly of those parts of the husk and other unwanted material not yet removed.

It is a disadvantage of the above-described process—which is known as the "break system" that a considerable number of rollers (usually between eight and thirty-six, but often more than thirty-two) must be employed to produce flour. However, even the use of perhaps thirty-two rollers does not give a very high grade of flour because it is not practicable to remove all the bran from the kernels.

This bran has little or no dietary value as it is too finely comminuted to be readily hydrated in the gut, and so contributes virtually nothing to the desirable fibre component of a diet. More seriously the remaining detritus in the flour will include not only the powdered husk but also unspecified dirt and tiny particles of insects such as curculionidea or weevils.

Attempts have been made to improve the quality of milled flour by increasing the effectiveness of the winnowing step between the rolling stages of the "break system" of milling, but this has proved to be disastrously uneconomic because a high proportion of the flour itself is also lost. This overall contretemps has produced a situation in which the chefs of many high quality restaurants insist on hand-ground flour, needless to say at high cost.

SUMMARY OF THE INVENTION

It is thus an object of the present invention to provide, in a flour milling system, means whereby the dehusking of grain is substantially complete before rolling (for the purpose of breaking the kernels) commences, and whereby the number of pairs of rollers may be thereby reduced whilst at the same time producing flour of improved quality as compared with that presently commercially available.

Therefore, in accordance with the present invention, there is provided a discoid element for a helical screw or worm arrangement, each side of which has therein a number of identical, shallow depressions; each one of the said depressions having an open end adjacent the periphery of the said discoid element and a closed end adjacent a central bore of the said element:

the geometry of the said central bore being such that, when a plurality of the said discoid elements are mounted on a shaft, a said helical screw or worm arrangement results:

and the disposition of said depressions being such that those of said depressions in one side of said discoid element are staggered, or offset, with respect to those in the other side thereof.

Ideally, each discoid element may consist of a pair of identical half-elements; preferably each element or half-element is a steel casting and is case hardened Advantageously, each element has an array of dehusking elements in the form of ribs upon the sides of the element, disposed radially thereupon, these rib elements constituting sidewalls of the said shallow depressions.

In accordance with a second aspect of the present invention, there is provided apparatus for the dehusking of grain, comprising an elongated frame; a horizontallydisposed driven shaft supported in bearings within an upper part of said frame; at least one helical screw or worm arrangement mounted about said shaft; a cylindrical mesh housing enclosing said at least one helical screw or worm arrangement; a plurality of hoppers within a lower part of said frame and beneath said housing; an outlet at the downstream end of said apparatus for removal of bran; a grain inlet at the upstream end of said apparatus; and means for rotatably driving the said shaft:

the or each helical screw or worm arrangement being composed of a plurality of discoid elements as herein described.

Preferably, the bran removal outlet and an outlet for dehusked grain discharge are both disposed in a casing which is rubber lined to avoid fracture of the dehusked grain.

In order that the reader may gain a better understanding of the present invention, hereinafter will be described a preferred embodiment thereof, by way of example only, and with reference to the accompanying drawings.

BRIEF DESCRIPTION OF THE DRAWINGS

Throughout the drawings, like integers are referenced by the same numeral.

DESCRIPTION DETAILED OF THE PREFERRED EMBODIMENTS

Figure 1:
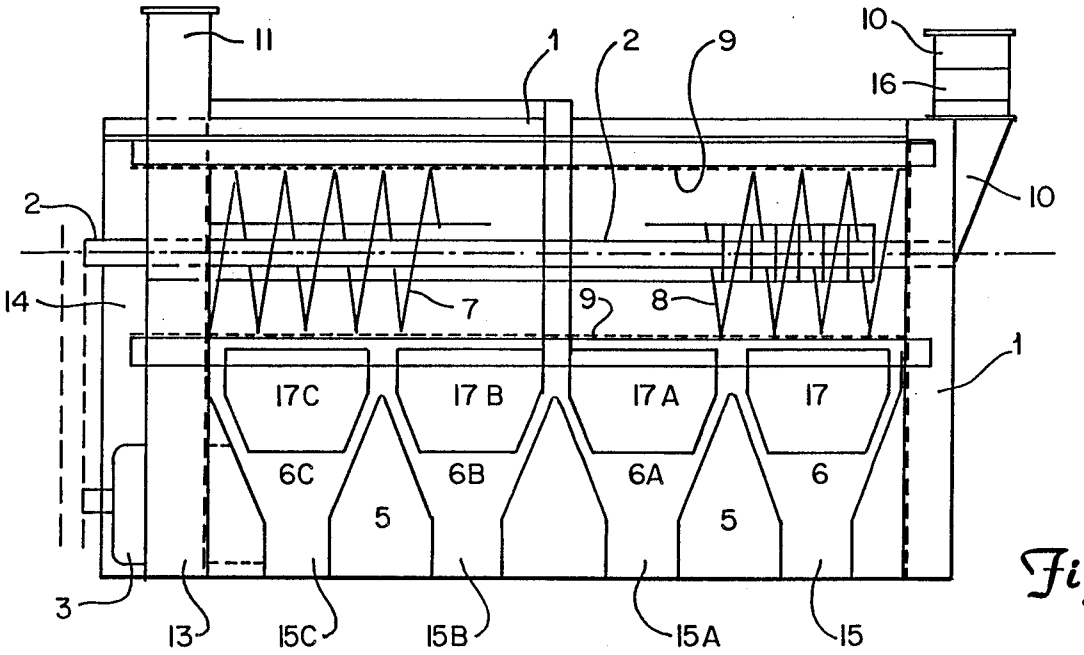
FIG. 1 is a part-sectional, diagrammatic side elevation of an apparatus incorporating the present invention.

In the drawings, there is to be seen an elongated frame 1 in which is supported a horizontally-disposed driven shaft 2, running in bearings. Shaft 2 is rotatably driven from an electric motor 3 via a transmission train of such as V-belts-and-pulleys. The motor 3 is mounted on a side-panel of frame 1, for a degree of vertical adjustment to correctly tension the V-belts.

Figure 2:
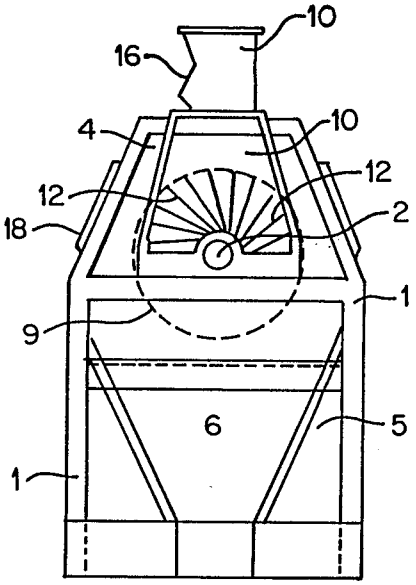
FIG. 2 is a corresponding front end elevation.

As will be noted, shaft 2 runs in the upper part 4 of frame 1, while in the lower part 5 is a plurality of hoppers, as 6 in FIG. 2.

Mounted upon shaft 2, for rotation therewith, is at least one, and ideally two in tandem, helical screw or worm arrangements, as those referenced 7 and 8 in FIG. 1, and enclosing it, or them, is a cylindrical steel mesh housing 9. The or each screw or worm arrangement may well be composed of a plurality of angularly-mounted steel discoid elements disposed along shaft 2 so as to form a helical flight of vanes. Each discoid element has an array of dehusking elements, these being ribs 12 mounted substantially radially upon the sides of the discoid elements. These screws or worms will be described in greater detail hereinafter with reference to FIGS. 4 and 5.

At the upstream end of the apparatus there is a grain inlet 10 and, at the downstream end an outlet 11 for the removal of bran under suction.

Also at the downstream end of the apparatus there is a dehusked grain discharge outlet 13, both it and bran removal outlet 11 being disposed in a casing 14 which is rubber lined to avoid fracture of the dehusked grain.

Figure 3:
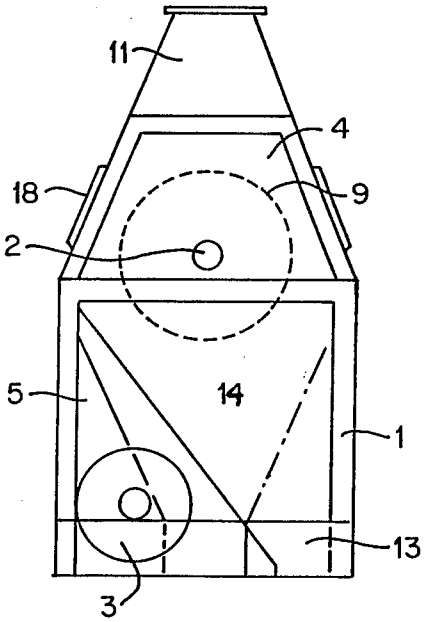
FIG. 3 is a corresponding rear end elevation.

In the embodiment shown, there are four in-line hoppers 6, 6A, 6B and 6C, each being as wide as the frame, at the top, tapering to outlets 15, 15A, 15B and 15C at the bottom, respectively for husk, husk/bran, fine bran etc. Grain inlet 10 is provided with an auxiliary air inlet 16 which is adapted to entrain the gravity-fed grain in an air-flow. However, in some applications, two in-line hoppers may be preferable; all hoppers may have a vertical discharge form, as in FIG. 2, or they may have an angled discharge form, similar to the dehusked grain discharge outlet 13, shown in FIG. 3.

The hoppers ideally have access panels 17, 17A to 17C and the upper part of frame 1 may also have somewhat similar access panels 18.

Figure 4:
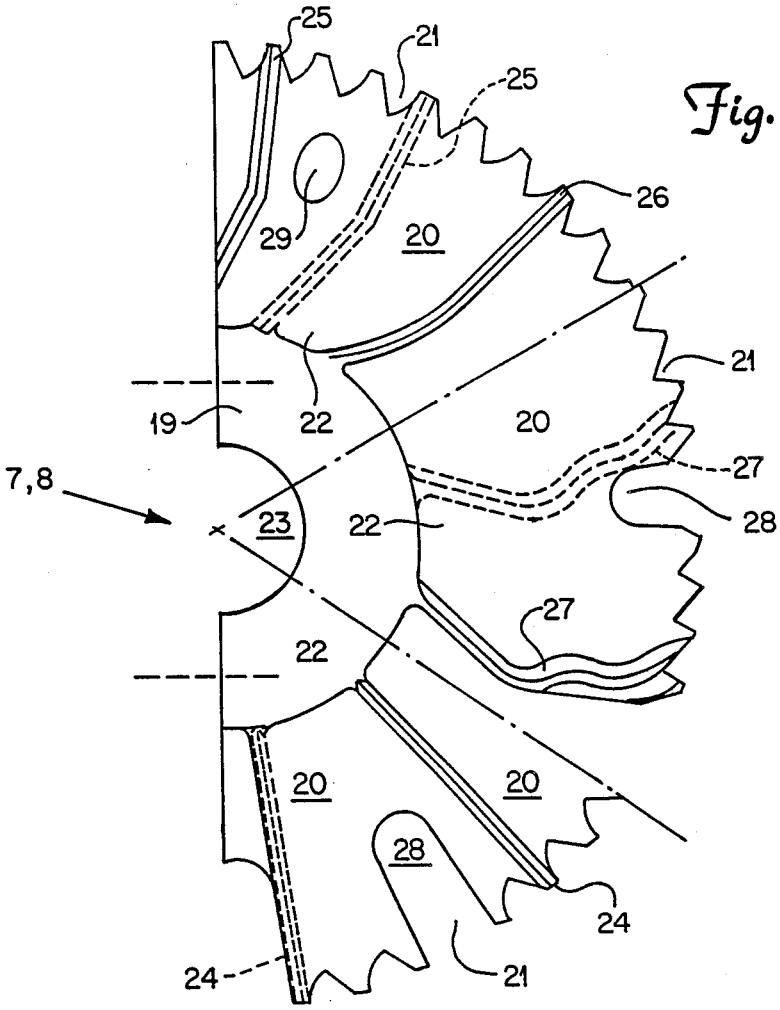
FIG. 4 is a composite drawing illustrating various configurations of shallow depressions and ribs.

FIG. 4 is a composite drawing for the purpose of illustraing various shapes and configurations of the shallow depressions and the ribs.

Preferably a discoid element 7, 8 consists of a pair of identical half-elements, as 19. Each side of each half-element 19 has cast therein a number of identical shallow depressions, as 20; each depression 20 has an open end, as 21, adjacent the periphery of the half-element and a closed end 22 adjacent a central bore 23; the periphery may be toothed as shown, these teeth may be of varied profile and size.

The geometry of central bore 23 is such that, when a plurality of the half-elements are mounted on shaft 2, a helical screw or worm arrangement results. The half-elements are so mounted that, at their closest points of approach, the peripheries of adjacent full discoid elements are about 10 mm. apart, and the diametricallyopposed points on their peripheries about 40–50 mm. apart.

Each half-element 19 is provided with an array of what may be termed dehusking elements, ideally in the form of substantially radially-disposed ribs cast upon the faces or sides of the half-element. These ribs may be geometrically radial, as 24; angled, as 25; curved, as 26; or sinuous, as 27, the sinuosity of the latter, adjacent the open end of a depression, aiding in the formation of inward grain-flow. In all cases, these ribs constitute sidewalls of the shallow depressions. The depressions may well have a bight, as 28, or an aperture, as 29.

Figure 5:
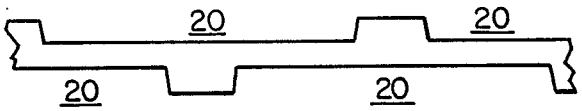
FIG. 5 is a scrap, schematic drawing aimed at showing staggering or offsetting of the depressions and ribs.

It is important that the depressions in one side of the half-element 19 be staggered, or offset, with respect to those in the other side; the schematic scrap drawing, FIG. 5, is merely intended to illustrate what is meant, and does not represent an actual cross-section.

While depressions on the "one sides" are offset with respect to those of the "other sides", in a completed worm arrangement all the depressions on "one sides" are not in register. As grain is impelled through the apparatus in turbulent flow, a side-to-side motion is imparted to it as a result of the particular juxtaposition of adjacent discoid elements and this aids in the dehusking of the grain.

Each half-element 19 is ideally a case-hardened steel casting having a roughened surface which also aids in dehusking.

While the discoid elements which form the screw arrangement have been described as radial rib-bearing, the dehusking elements may well take any other form, for example, foraminations, serrations, grooves, either smooth, or rubber, or plastic coated, textured in any suitable manner, or given an intaglio pattern.

Moreover, each discoid element may be composed of quarter-elements, or even be only a three-quarter-discoid element.

Whatever may be envisaged, the criterion is only that they will be capable of dehusking grain.

Thus, by the use of various dehusking elements and/or by varying their angles, shapes, numbers, sizes and/or spacings and the surface pattern or texture, a wide variety of grains may be dehusked as for example wheat, barley, oats, buckwheat, sorghum, millet, rice, and other cereal grains including such Eastern grains as mung beans, borghul, chick peas, as well as such other products as certain nuts.

Use of the inventive apparatus makes it feasible to free grain of its outer covering irrespective of whether the grain is wet or dry. The apparatus thoroughly 'cleans' each individual grain so that it leaves the apparatus completely dehusked and dust-free; thus, if the miller is provided with such completely dehusked kernels as above described, he will have no need to use so-called "cleaning" rollers at all—at a considerable saving in power usage.

Throughput capacity is envisaged to be perhaps 18 tonnes per hour, power requirements being readily provided by a 15 kilowatt electric motor providing from 600 to 1000 r.p.m. and ideally 800 r.p.m.

While prior art apparatus rarely yields 76% of usable flour—the remainder being contaminated with husk material—the device of the present invention yields 90% of usable flour, a huge increase of great economical importance.

For a particularly extensive milling operation, it will be advantageous to install two inventive dehusking apparatus—the first one down stream from the usual vibrating grain sifter and the second downstream from the usual transit rest container, and hence onto the grinding mill.

From the abovegoing, it will be readily appreciated by those skilled in the art that numerous variations and modifications may be made to the invention without departing from the scope and spirit thereof as set out in the following claims.

What is claimed is:

1. In an apparatus for dehusking grain wherein a helical screw having a central bore therethrough is rotatably and concentrically mounted on a generally horizontal axis within an at least partly cylindrical housing, wherein means is provided to rotate the screw within the housing, wherein unhusked grain is introduced into a first end of the housing, is dehusked and moved through the housing by the screw and is discharged from a second end of the housing as dehusked grain; the improvement wherein:

(a) the helical screw is made up of a plurality of discoid elements, each side of each discoid element being formed to provide a number of shallow compartments, each compartment being partially defined by a pair of substantially radially disposed ribs extending away from the surface of said discoid element;

(b) each such compartment has an open end adjacent the outer periphery of the discoid element and a closed end adjacent the central bore of the helical screw;

(c) the compartments are disposed so that those on one side of a discoid element are staggered and offset with respect to the compartments on the other side;

(d) each of the discoid elements is provided with an array of dehusking elements upon its helical surfaces; and (e) grain impelled through the cylindrical housing is subjected to agitated, turbulent flow by contact with the discoid elements of the helical screw thereby removing husk material from the grain.

2. The apparatus of claim 1 wherein:

(f) each of the discoid elements consists of a pair of identical half elements.

3. The apparatus of claim 1 wherein:

(f) each discoid element has a plurality of radial teeth about its periphery.

4. The apparatus of claim 1 wherein:

(f) each discoid element is a case-hardened steel casting.

5. The apparatus of claim 1 wherein:

(f) the array of dehusking elements includes rought-extured surfaces provided on each discoid element to enhance dehusking.

6. The apparatus of claim 1 wherein:

(f) the apparatus includes an elongated frame, a horizontally disposed driven shaft rotatably mounted in the frame in concentric relation to the at least partly cylindrical housing and integrally connected to the cylindrical bore of the helical screw;

(g) said cylindrical housing is of at least partially perforate mesh construction such that grain husks can pass through the housing and the bulk of the grain cannot;

(h) a plurality of hoppers are disposed with respect to the frame in position to receive husk material passing from the housing;

(i) a grain inlet is provided to introduce unhusked grain at an upstream end of the housing; and (j) outlets are provided for discharging dehusked grain and all remaining husk material from the downstream end of the housing.

* * * * *